United States Patent [19]

Pengler

[11] Patent Number: 4,673,179

[45] Date of Patent: Jun. 16, 1987

[54] EXERCISING DEVICE

[76] Inventor: Rudolf Pengler, 1400 Millersport Hwy., #26, Williamsville, N.Y. 14221

[21] Appl. No.: 770,840

[22] Filed: Aug. 29, 1985

[51] Int. Cl.[4] ..... A63B 11/00; A63B 21/00

[52] U.S. Cl. ..... 272/93; 272/122; 272/143

[58] Field of Search ..... 446/85; 273/58 D, 55 R, 273/55 D, 55 A, 58 C, 58 K, 428; 272/93, 122, 123, 113, 67–68, 109, 135, 143; D21/191–198, 199, 204; 434/403; 220/94 A; 206/509, 510

[56] References Cited

U.S. PATENT DOCUMENTS

| | | | |
|---|---|---|---|
| D. 240,150 | 6/1976 | Lau . | |
| D. 242,865 | 12/1976 | Stamm . | |
| 3,396,969 | 8/1968 | Rosenfeld | 273/55 R |
| 3,558,135 | 1/1971 | Rees | 273/55 A |
| 4,079,932 | 3/1978 | Schuetz | 272/75 |
| 4,515,364 | 5/1985 | Rotella | 272/135 |

FOREIGN PATENT DOCUMENTS

| | | | |
|---|---|---|---|
| 364936 | 1/1932 | United Kingdom | 220/94 A |

*Primary Examiner*—Richard J. Apley
*Assistant Examiner*—S. R. Crow
*Attorney, Agent, or Firm*—James J. Ralabate

[57] ABSTRACT

A device is disclosed for performing gymnastic exercises or the like, comprising a geometrically regular body including a plurality of polygonally-shaped flat sides and a plurality of spaced handle means. The handle means are defined by at least two elongated spaced openings in the surface of the body which flank the intersection between two of the flat sides. These openings cooperate with at least the remaining portion of the surface intervening therebetween to define elongated graspable hand-holds at the facial intersections.

6 Claims, 7 Drawing Figures

FIG.1
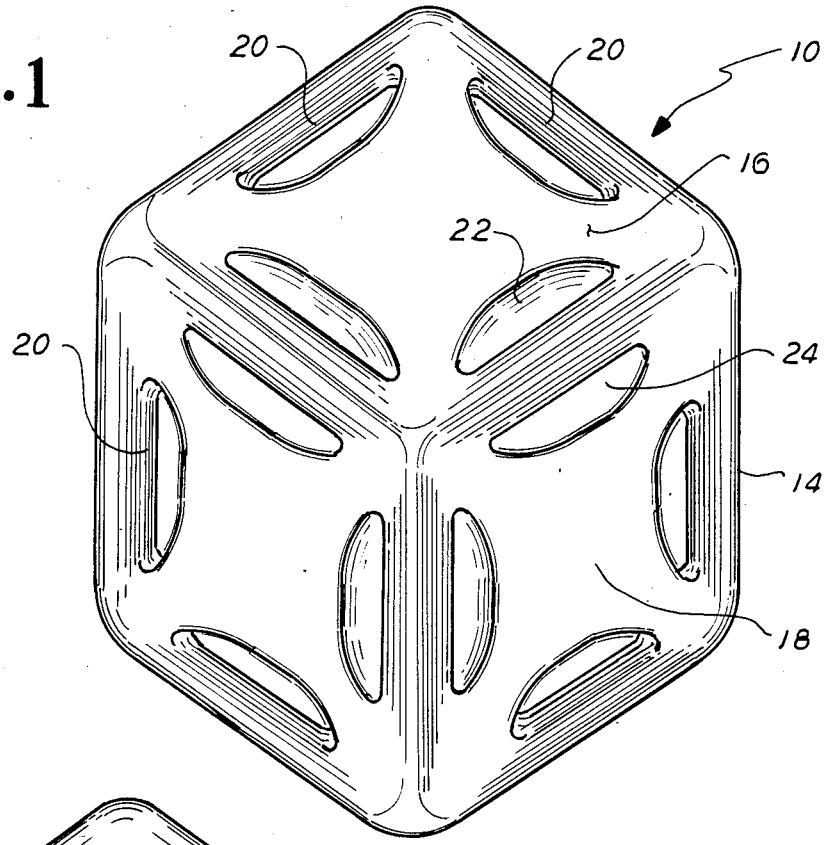
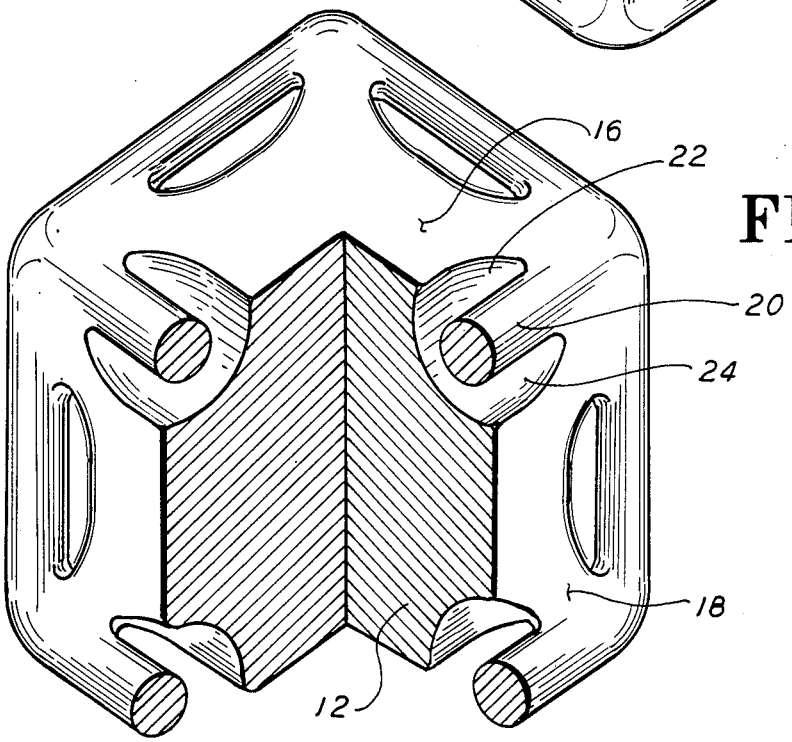
FIG. 2

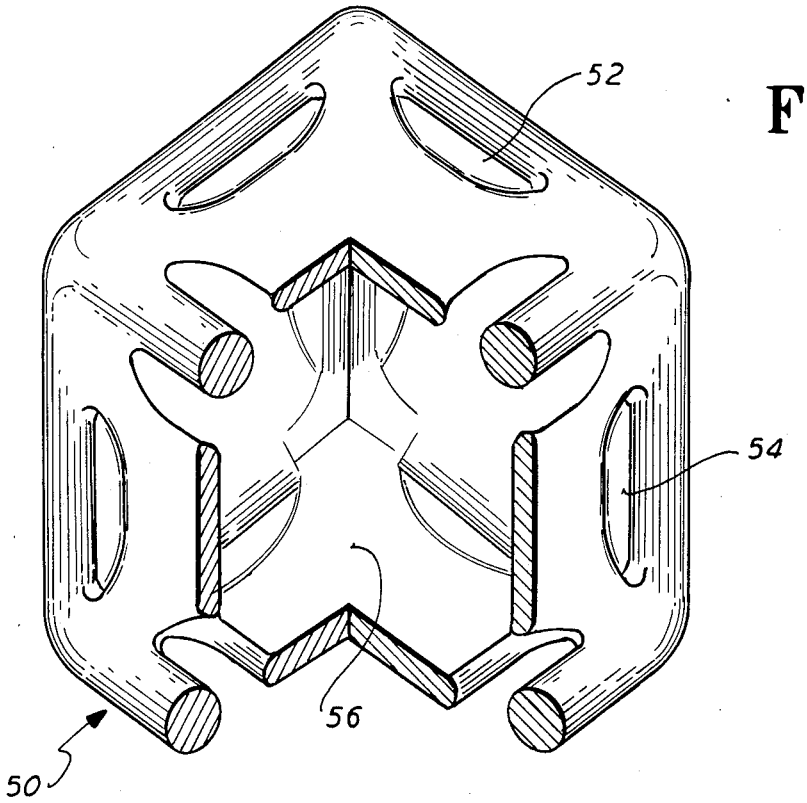
FIG. 5
FIG. 6
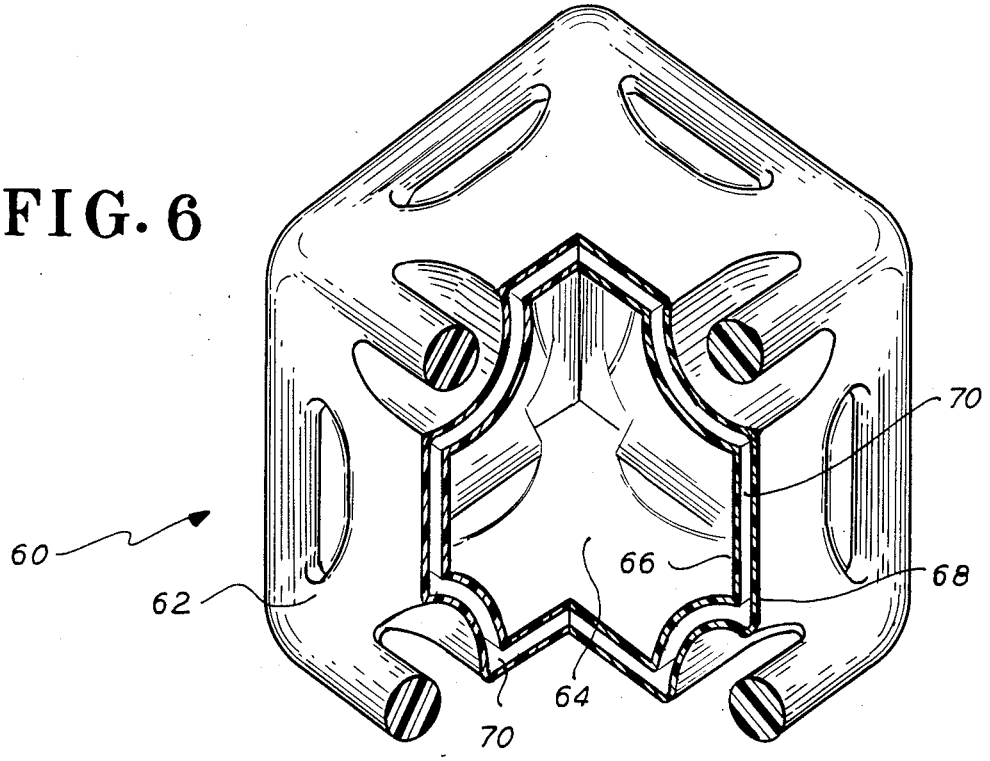

EXERCISING DEVICE

BACKGROUND OF THE INVENTION

This invention relates generally to exercising and gymnastic equipment and devices, and more specifically relates to a portable device, useful in performing gymnastic exercises or the like.

Various compact weighted and unweighted devices have been known for very many years for use by individuals in the course of body building exercises, or in gymnastic-related activities or the like. For example, very numerous types of so-called "dumbbells" are exceedingly well-known in the art. These generally are constituted by weighted elements interconnected by a reduced cross-sectioned handle portion. Many variations upon this type of concept are shown in the prior art.

For example, a very old U.S. Pat. No. 660,962 to Kennedy, discloses a combined dumbbell and indian club, which device comprises a weighted block having a central longitudinal opening extending through same. A handle portion passes through the opening and is threadingly received at its distal end. Such handle can be removed from the center, and reinserted at the threaded end of the block from the outside, to thereby provide an indian club.

In Wright, U.S. Pat. No. 4,029,312, a weight lifting or exercising device is set forth, which includes a pair of hollow and generally spherical shells attached to the end of a bar. The shells include hollow compartments, which can be filled or emptied of foreign materials such as water, sand, shot or the like, to selectively increase or decrease the mass of the individual weights.

U.S. Pat. No. 4,351,526 to Schwartz, discloses a dumbbell structure adapted for aerobic and related extended-type exercises, in which an elongated body member is provided with a soft, resilient, central hand portion. A threaded portion is provided at each end of the hand portion, so that a pair of removable weights can be threaded on these ends.

U.S. Pat. No. 4,079,932 to Schuetz, discloses a pair of adjustable weight members interconnected by a skip rope. Each of the exercise members has a chamber, to which water or other fluent material is added in a predetermined weight amount suitable for the user.

Other prior art patents of interest to the present invention includes Solloway, U.S. Pat. No. 4,311,306, and Liberatore, U.S. Pat. No. 4,121,826.

The present invention is particularly concerned with a type of use, which the prior art, including the abovementioned prior U.S. patents, has failed to lend itself.

In particular, in recent years, a considerable interest has developed in a type of exercise format, which is akin to gymnastics, or to the type of exercise sometimes loosely labeled "aerobics". In this newer type of exercise routine, the individual may engage in highly fluid, graceful movements, often akin to dancing, or to certain types of gymnastics, with the routine often being accompanied by appealing music, to which indeed the exercises are rhythmically performed. Many of these exercises are performed by individuals who are not necessarily engaged or interested in extremely heavy body building routines, but simply are interested in toning musculature to provide a firm and attractive body, i.e. excessive muscle building is not necessarily an objective of this type of exercise.

While many of these types of newer exercises are performed without the aid of any adjunct weights or other devices, it is highly desirable, in order to more rapidly yield results from such exercises, to make use of adjunct devices, which are sometimes weighted—such as dumbbells, or the like. However, the physically unattractive and unversatile dumbbells and similar devices of the prior art are not particularly suited for use in this type of exercise. Among other things, the conventional dumbbell and similar devices, do not include features which enable ready and fluid movement or displacement of such devices from one to the other hand, or from the hands of one user to those of another user. The said dumbbells and the like further, essentially require that they be grasped in one relatively fixed position. They are not susceptible to a variety of uses, and of manipulations beyond the specific grasping posture which they are usually designed to facilitate.

In accordance with the foregoing, it may be regarded as an object of the present invention, to provide an exercise device for use in exercise, in gymnastic routines or the like, which is attractive and appealing in appearance, and which is provided with specific adaptations enabling the said device to be readily manipulated from all sides of same, to be moved from one to the other hand by the user with ease, and/or to be readily passed from one to another user.

It is a further object of the invention, to provide an exercising device as aforementioned, which is of sturdy, relatively inexpensive construction, to thereby enable it to stand up to hard use for an extended period, including to the wear and tear that results from droppage during the exercising routine, etc.

It is a further object of the invention to provide an exercising device of the aforementioned character, which can be constructed to be of relatively high weight, or can be constructed as to have intermediate, or relatively low weight values, thereby to enable the device to find use by a variety of individuals engaged in different types of exercise functions.

A still further object of the present invention, is to provide an exercising device of the aforementioned character, which possesses interesting and aesthetically appealing characteristics, thereby enabling it to be readily placed or stored in an office, den, or the like, without creating the unsightly appearance of prior art apparatus intended for exercise applications.

It is a still further object of the invention, to provide apparatus of the aforementioned character, which may be produced in a variety of shapes and sizes, all of which, however, perform the same essential functions, and achieve the aforementioned objectives, with a high degree of efficacy.

SUMMARY OF INVENTION

Now, in accordance with the present invention, the foregoing objects and others as will become apparent in the course of the ensuing specification, are achieved in a device for performing gymnastic or weightlifting exercises, or the like, which comprises a geometrically regular body, including a plurality of polygonally-shaped flat sides, and a plurality of spaced handle means, each handle means being defined by at least two elongated spaced openings in the surface of said body, which flank the intersection between two flat sides, and which cooperate with at least the remaining portion of the surface intervening therebetween to define elongated graspable hand-holds at the facial intersections.

The device in accordance with the present invention may comprise a cube, or other attractive geometric shape, such as a pyramid.

The body of the present device may be substantially solid, or can comprise a composite with an outer low density portion, and an inner high density core. The body also can comprise a shell, which surrounds a hollow interior. Where weighted characteristics are required, the shell can comprise a metal, dense plastic, or other material. Where weight is not desired, the shell can also comprise a pair of spaced flexible plastic walls, the void therebetween being fillable with pressurized air.

BRIEF DESCRIPTION OF THE DRAWINGS

The invention is diagramatically illustrated by way of example in the drawings appended hereto, in which:

FIG. 1 is an external perspective view of an exercising device in accordance with the present invention;

FIG. 2 is a partially cut away perspective view of the device of FIG. 1;

FIG. 5 is an external perspective view similar to FIGS. 2, 3, and 4, but showing a yet further embodiment of the invention.

FIG. 6 is an external perspective view, showing a further embodiment of the invention, based upon a flexible-walled inflatable shell.

DESCRIPTION OF PREFERRED EMBODIMENT

Figure 3:
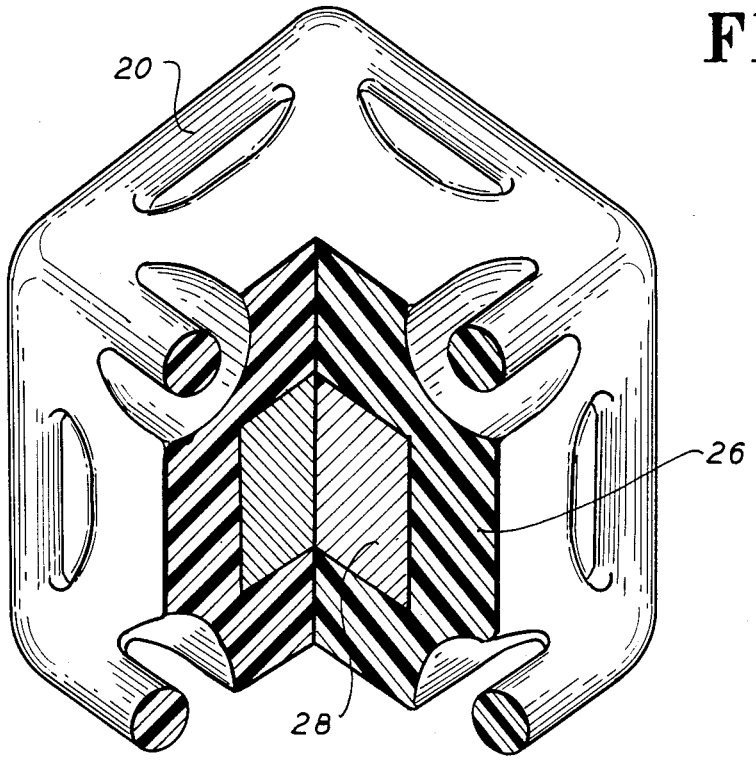
FIG. 3 is a view similar to FIG. 2, but showing a further embodiment of the invention.

In FIG. 1, a perspective view appears of an exercise device 10, in accordance with the present invention. The view of FIG. 1 may be considered simultaneously with the partially cut away view of FIG. 2, which depicts the interior of the FIG. 1 device.

As seen from these figures, the device 10 is substantially a cubic body comprised of a molded or otherwise formed one piece solid body, whereby the interior 12 of same is uniform in nature. The material comprising the cube 10 can be, for example, a dense plastic, or can be a heavier material as, for example, a ceramic, a concrete aggregate, or other dense substance, even including metals such as aluminum or otherwise.

Each edge 14 of the cube is seen to be rounded. The cube has a plurality of flat faces, such as top face 16, side face 18, etc. Handle portions 20 are formed into the body at each of the intersections of adjoining flat faces, such as at the intersection of face 16 and 18, by pairs of openings or recesses 22 and 24, which are formed into the surfaces of the body at the adjoining faces. The paired recesses such as 22 and 24 intersect each other as seen in FIG. 2, beneath the surface defined by faces 16 and 18, so that they define with the remaining intersection between faces 16 and 18, the hand graspable portion 20. The recesses are so formed, i.e., curved as seen in FIG. 2, so that they cooperate with rounded edges of the cube, whereby the hand graspable portion 20 is of cylindrical cross section. This enables the user to readily grasp the said portions 20.

It is thus seen in accordance with the invention that the cube of FIGS. 1 and 2 is provided with a cylindrical hand-graspable portion 20 at each of its twelve edges. Similarly, each face of the cube has effectively a cylindrical grasping portion at each of its lateral sides. It will be evident, therefore, that a total of twelve grasping handles are actually provided on the entire cube. Thus, the user of the said device can grasp same in a myriad of positions and readily pass the cube from one hand to another, or can pass the cube readily to another user as part of an exercise pattern or routine.

In FIG. 3 a perspective view appears, cut-away as in FIG. 2, depicting an alternative embodiment of the present device. In this form of the invention, instead of the interior being of uniform composition, it is seen that an outer layer or portion 26 surrounds an inner contiguous core 28, which inner core can be of a denser material than the outer core 26. This enables a more highly weighted device to be provided. For example, the outer portion 26 can comprise a relatively low density plastic molding, whereas the inner core 28 can comprise a much heavier metallic core.

Figure 4:
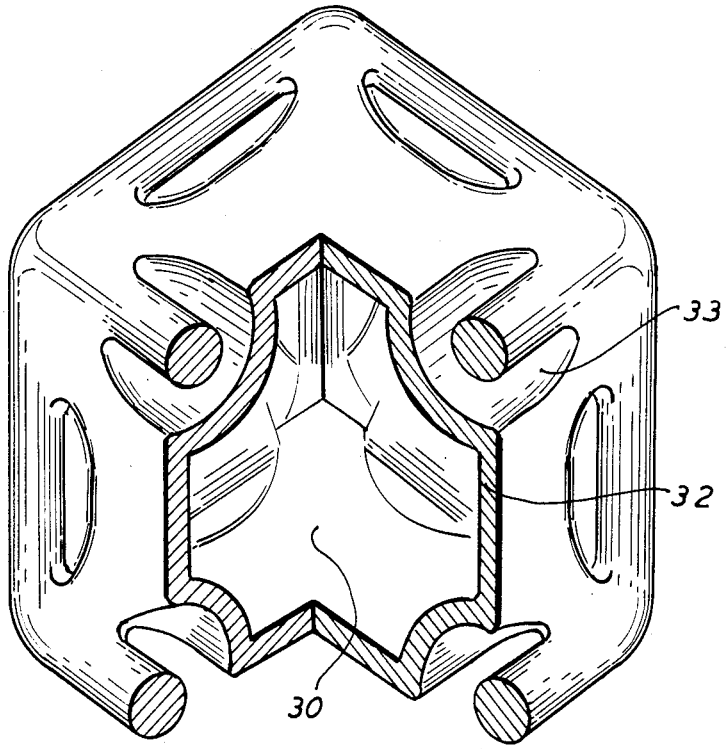
FIG. 4 is a view, again similar to FIGS. 2 and 3, but showing a yet additional embodiment of the invention.

In FIG. 4, a yet further embodiment of the invention appears. In this form of the device, the center 30 of the device is hollow, with the body of the cube being defined by a relatively thin shell 32. In order to provide sufficient weight in this form of the invention, the shell 32 preferably comprises a high density material, such as a metal, which can be cast or otherwise suitably formed to provide the indicated shape.

The device 50 shown in FIG. 5 is again cubic in form and is generally similar to the apparatus depicted in FIG. 4 except that the structure has now been somewhat further simplified by the web portions 33 of FIG. 4 being eliminated so that the interior of the hollow device 50 is completely visible and accessible through the openings such as 52, 54 etc. into the shell interior 56.

In FIG. 6, a yet further embodiment of the present invention appears which structurally is similar to the devices of FIGS. 4 and 5 in the sense of constituting a shell 62 which surrounds a hollow interior 64. However, in this instance, the shell 62 is actually defined by spaced walls 66 and 68 which preferably comprise a flexible plastic or rubber-like material, i.e. a material having elastomeric properties to define therebetween a chamber 70 which can be filled, through a suitable valve connecting with the chamber, with compressed air or the like. Thus, in this form of the invention, the device 60 is inflatable by manual or other means to provide a soft surfaced exercise device which is readily usable at the beach or other environment and which can be collapsed for storage.

Figure 7:
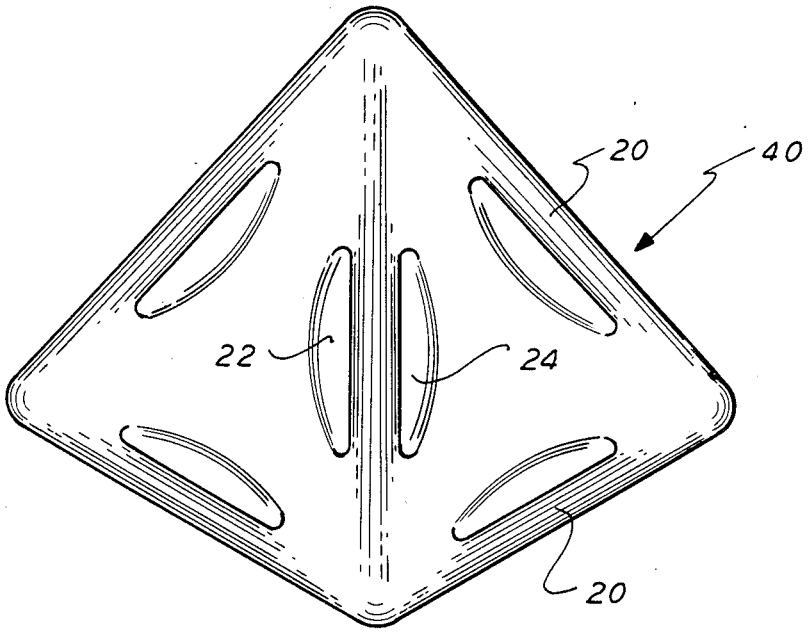
FIG. 7 is a further external perspective view, similar to FIGS. 2 through 5, but showing a still further embodiment of the invention.

The present device has been thus far described in the form of a cube which is a preferable embodiment of the device, and as it is very utilitarian, enables a large number of grasping portions, and is very easily manipulated by the user. However, other geometrically appealing and useful forms are equally within the province of the invention. One such further embodiment is shown in FIG. 7, wherein the precise principles aforementioned are utilized in connection with a pyramid structure.

Again, pyramid 40 is provided with a plurality of handle portions 20, which are similarly formed as in the embodiments of FIGS. 1 through 6, i.e., by openings 22 and 24 formed in the adjoining flat faces, which cooperate with the remainder of the intersect between adjoining faces of the pyramid to form the handle portions in the manner aforementioned.

The present invention has been particularly set forth in terms of specific embodiments thereof. It will be understood in view of the instant disclosures, however, that numerous variations upon the invention are now enabled to those skilled in the art, which variations yet reside within the scope of the present teachings. Accordingly, the invention is to be broadly construed; and limited only by the scope and spirit of the claims now appended hereto.

I claim:

1. A weight-lifting device having an outer shell layer and an inner shell portion and comprising a geometrically regular body, including a plurality of polygonally-shaped flat sides, and a plurality of spaced handle means, each said handle means being defined by at least two elongate spaced openings in the edge surface of said body, which flank the intersection between two said flat sides, and which cooperate with at least the remaining portion of the surface intervening therebetween to define a plurality of elongated graspable hand-holds at said facial intersections, said hand-holds having a substantially cylindrical circumference which is capable of being substantially completely encircled by a user's hand, the inner shell portion of said device being accessible through said spaced openings for providing said inner shell with a different density than that of said outer layer, so as to alter the overall weight of said device.

2. A device in accordance with claim 1, wherein said device comprises a cube.

3. A device in accordance with claim 2, wherein said body is substantially solid.

4. A device in accordance with claim 2, wherein said body comprises a shell surrounding a hollow interior.

5. A device in accordance with claim 4, wherein said shell is a high density solid.

6. A device in accordance with claim 1, wherein said body is defined by a hollow interior surrounded by a shell comprising a pair of spaced flexible walls.

* * * * *